United States Patent [19]

Banks, Jr.

[11] 4,277,716

[45] Jul. 7, 1981

[54] GLASS-TO-METAL SEAL CONSTRUCTION

[76] Inventor: Neill K. Banks, Jr., 6 Arlington St., Gloucester, Mass. 01930

[21] Appl. No.: 82,919

[22] Filed: Oct. 9, 1979

[51] Int. Cl.[3] ..... H01J 17/16

[52] U.S. Cl. ..... 313/220; 174/50.5; 313/219; 313/331; 313/332; 428/426; 428/433; 428/434; 428/472; 428/630; 428/663; 428/664; 428/665; 428/680

[58] Field of Search ..... 428/433, 472, 426, 434, 428/630, 637, 663, 664, 665, 680; 313/331, 332, 219, 220; 174/50.5

[56] References Cited

U.S. PATENT DOCUMENTS

| | | | |
|---|---|---|---|
| 2,200,694 | 5/1940 | Gerecke | 428/630 |
| 2,759,252 | 8/1956 | Embden | 428/630 |
| 2,892,113 | 6/1959 | Germer | 313/332 |
| 3,100,168 | 8/1963 | Beeson | 428/432 |
| 3,115,957 | 12/1963 | Heil | 428/432 |
| 3,275,358 | 9/1966 | Shonebarger | 428/432 |
| 3,275,359 | 9/1966 | Graff | 428/432 |
| 3,474,287 | 10/1969 | Church | 313/220 |
| 3,551,720 | 12/1970 | Kilborn | 313/220 |
| 3,783,094 | 1/1974 | Baum | 428/433 |

FOREIGN PATENT DOCUMENTS

| | | | |
|---|---|---|---|
| 588184 | 5/1947 | United Kingdom | 428/432 |
| 635593 | 4/1950 | United Kingdom | 428/432 |
| 675599 | 7/1952 | United Kingdom | 428/432 |

*Primary Examiner*—Ellis P. Robinson

[57] ABSTRACT

There is disclosed herein a glass-to-metal seal construction especially adapted for use in the fabrication of devices of the compact arc discharge lamp or gas discharge laser type.

12 Claims, 1 Drawing Figure

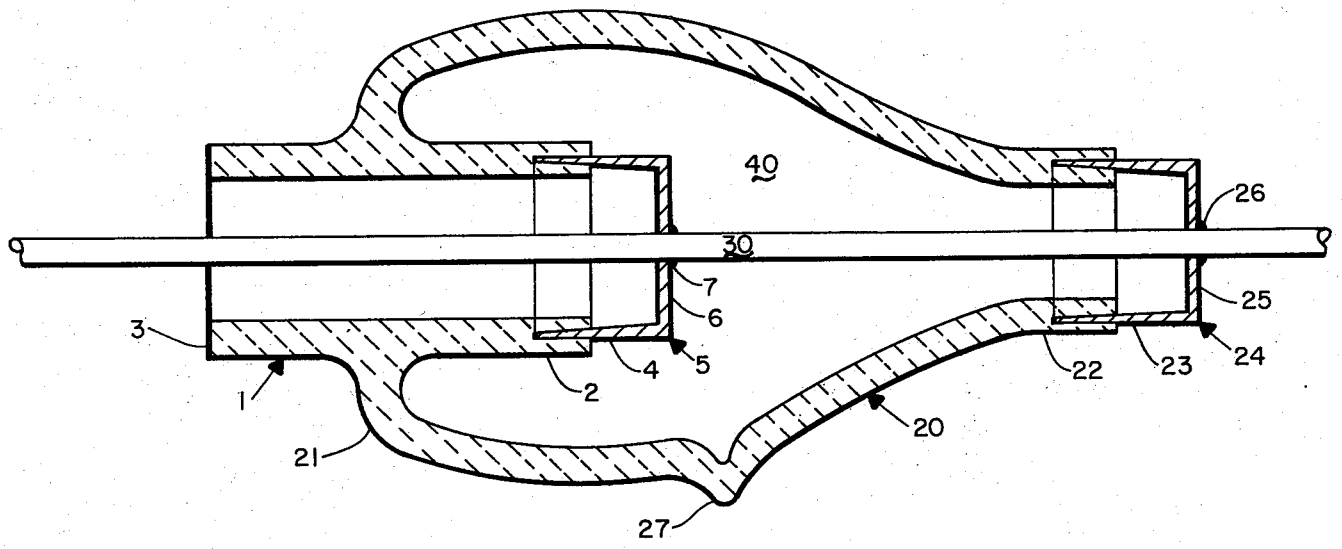
26
25
24
23
22
20
40
30
7
6
5
4
2
27
21
1
3

GLASS-TO-METAL SEAL CONSTRUCTION

FIELD OF THE INVENTION

The present invention relates generally to glass-to-metal seal constructions and is more particularly concerned with a glass-to-metal seal construction specifically adapted for use in the fabrication of devices of the arc discharge lamp or gas discharge laser type.

BACKGROUND OF THE INVENTION

Over recent years there have been developed various compact arc discharge lamps and gas discharge lasers. Broadly, such devices comprise a tubular quartz envelope having at least two metallic seals composed of a refractory metal associated therewith, said seals being typically composed of molybdenum or tantalum. Electrode rods, which are typically composed of tungsten, are carried from the metallic seals into the quartz envelope in a manner suitable to maintain the hermetic seal thereof. The quartz envelope of the device is filled to a pressure of up to about 14 atmospheres (1,418,550 Pa) with a noble gas, such as xenon, argon or radon and, typically, one or more condensible metals, halogens and/or metal halides such as the halides of tin, mercury, scandium, iron, sodium, thallium, indium and rare earth metals. The principal role played by the halogen or halide components is to establish a transport cycle mechanism for the metal or metalloid values within the envelope. The practical benefits of the metal halide components contained or found within the envelope are to preserve electrode life and optical clarity of the quartz envelope and also to tailor the light emissions to the desired wavelengths. In operations, an arc is struck across the electrodes of the device, thereby generating intense luminosity and vaporizing condensible materials contained or formed within the envelope. As the environment within the quartz envelope heats the resistance across the arc normally diminishes. Accordingly, a current limiter is usually placed in circuit with the device in order to properly adjust the current in response to such resistance changes.

While devices of the compact arc discharge lamp and gas discharge laser type possess the considerable advantages of intense light output of controlled wavelengths at high efficiencies, nevertheless they are also possessed of several considerable disadvantages which have mitigated against more widespread applications thereof.

Firstly, it is desirable that operations of such devices be undertaken at internal temperatures sufficiently high as to prevent condensation of the condensible components thereof, particularly the halides, upon the refractory metal seals of the quartz envelope. This is so because said condensible components are often found to be quite corrosive with respect to refractory metal seal materials such as molybdenum or tantalum when contacted therewith at elevated temperatures. This internal corrosion, of course, can lead to short service life of the device and, moreover, failure of the refractory metal seals during operations under the relatively high internal pressures involved can be of a catastrophic nature. Thus, compact arc discharge lamps and gas discharge lasers are desirably operated such as to maintain the seal portions thereof at temperatures in excess of the condensation temperatures of the metal and/or metal halide components contained within the envelope, say, on the order of above about 400° C.

On the other hand, the refractory metal seal elements of such discharge devices generally are susceptible of oxidative degradation when contacted with an oxygen-containing atmosphere at elevated temperatures. For instance, molybdenum, a typical refractory metal material, oxidizes excessively rapidly in air at temperatures of above about 350° C. Thus, it is often found that maintenance of high temperatures at the seal portions of the device, while desirable from the standpoint of avoidance of condensation of metals and metal halides and internal corrosion of the metal seals, is in fact not practicable when considered from the standpoint of external oxidation of said metal seals. In view of the foregoing competing interests, therefore, it is normally the case that discharge devices of the foregoing type are usually operated under compromised conditions such that only some portions thereof are maintained at desirably high temperatures. For instance, the metal seal-containing portions of such devices are often externally cooled during operations in order to avoid excessive external oxidation of the seals. This concession to external oxidation, however, fosters the condensation and internal corrosion problems mentioned previously and can also generate mechanical stress problems arising from the thermal coefficient of expansion mismatches inherently existing as between the quartz envelope and the metallic seal and electrode elements of the construction.

These mechanical stress problems are generally addressed in the prior art by means of various complex glass-to-metal press seal constructions of the multiple ribbon, rod or graded types whereby several different glass compositions of intermediate thermal coefficients of expansion are interposed between the low coefficient quartz envelope and the relatively much higher coefficient refractory metal seals in order to avoid or at least better distribute thermally induced mechanical stresses. The production of such glass-to-metal seals is complex, time consuming and expensive and, even in the most favorable light, the multiple glass composition seals constitute only a partially effective expedient since they neither resolve the condensation problem nor do they avoid the need for protection of the metal seal elements from external oxidation thereof.

In accordance with the construction of the present invention, however, these problems have either been essentially completely resolved or at least substantially ameliorated.

It is a principal object of the invention to provide a novel glass-to-metal seal construction.

It is another object of the invention to provide a glass-to-metal seal construction suitable for use in the fabrication of discharge devices of the compact arc discharge lamp or gas discharge laser type wherein the need for external cooling of the seal-containing portions of the device in order to avoid excessive external oxidation of refractory metal seal elements is relieved.

It is another object of the invention to provide a glass-to-metal seal construction suitable for use in the fabrication of discharge devices of the compact arc discharge lamp or gas discharge laser type wherein temperatures above the condensation temperatures of condensible components contained within the envelope of the device may be maintained at the seal-containing portions thereof without excessive external oxidation of the refractory metal seal elements.

It is another object of the invention to provide a glass-to-metal seal construction suitable for use in the fabrication of devices of the compact arc discharge lamp or gas discharge laser type wherein external cooling of the end portion of said seal construction may be employed without substantially reducing the temperature within the galss envelope of the device.

It is another object of the invention to provide a novel direct quartz-to-metal seal construction suitable for use in the fabrication of devices of the compact arc discharge lamp or gas discharge laser type wherein mechanical stresses due to thermal coefficient of expansion mismatches between the metallic and quartz elements of the construction are at least partially compensated.

It is still another object of the invention to provide a glass-to-metal seal construction wherein the glass elements thereof are composed of a single glass composition.

Other objects and advantages of the invention will in part be obvious and will in part appear hereinafter.

SUMMARY OF THE INVENTION

Broadly, the glass-to-metal construction of the invention comprises first and second tubular glass elements, first and second cup-shaped refractory metal seal elements and a refractory metal electrode rod. The first tubular glass element has sealingly embedded in one end thereof the sidewall of the first cup-shaped refractory seal element. One end of the second tubular glass element is of a diameter sufficient to receive said first tubular glass element and is fused to said first element intermediate its ends. Said second tubular glass element extends rearwardly to beyond the one end of said first tubular glass element and has sealingly embedded therein the sidewall of said second cup-shaped refractory metal seal element. The refractory metal electrode rod passes from the base of said second cup-shaped refractory metal seal element through the base of said first cup-shaped refractory metal seal element and is sealingly affixed to each said base, thereby to define between the elements of the construction a hermetically sealed chamber. Said chamber is evacuated to subatmospheric pressure.

THE DRAWING

The drawing forming part hereof is a schematic, diagrammatic longitudinal section of a glass-to-metal seal construction in accordance with the invention.

DESCRIPTION OF PREFERRED EMBODIMENTS

Referring now to the drawing, the glass-to-metal seal arrangement of the present invention comprises a first tubular glass element 1, preferably of cylindrical shape, having one free end 2 and another free end 3 thereof. Sidewall 4 of a first cup-shaped refractory metal seal element 5 is sealingly embedded into the one free end 2 of said first tubular glass element 1. A second tubular glass element 20, having one end 21 and another end 22, overlies the rearward portion of said first tubular glass element 1. Said one end 21 of said second tubular glass element 20 has a bore of sufficient diameter as to receive said first tubular glass element 1 and is sealingly fused thereto intermediate the ends 2 and 3 thereof. Said second tubular glass element 20 extends rearwardly from its one end 21 to beyond the end 2 of said first tubular glass element 1. End 22 of said second tubular glass element 20 is preferably, but not necessarily, positioned coaxially with respect to end 2 of said first tubular glass element 1 and has sealingly embedded therein sidewall 23 of a second refractory metal cup-shaped seal element 24, said first and second cup-shaped metallic seal elements 24 and 5 thereby being held in spaced relation to one another. Extending from base 25 through base 6 of second and first refractory metal cup-shaped sealing elements 24 and 5, respectively, is a refractory metal electrode rod 30 which, preferably, extends beyond the free end 3 of the first tubular glass element 1. Said electrode rod 30 is sealingly affixed to the bases 6 and 25 such as by means of gold alloy or nickel alloy brazed joints 7 and 26, respectively.

As will be appreciated from the foregoing description, the glass-to-metal seal construction of the invention defines a hermetically sealed chamber 40. In accordance with the invention, the chamber 40 is evacuated to subatmospheric pressure through the wall of second tubular glass element 20 and the hermetic seal completed by pinching off said wall, at 27, employing conventional glass forming techniques. The extent of evacuation of said chamber 40 need not be great in order to achieve the substantial benefits of the invention. For instance, I have found that evacuation of chamber 40 to a pressure of about 50μ, Hg (6.66 Pa), a pressure which is readily achievable by use of conventional mechanical pump-down means, yields very substantial benefits.

While substantially any glass can be utilized in the fabrication of the first and second tubular glass elements 1 and 20, I much prefer that fused quartz be employed for the glass elements of the construction. Primarily, this preference resides in the fact that the glass-to-metal seal construction of the invention is specifically, but not solely, adapted for use in conjunction with high temperature discharge devices of the compact arc discharge lamp or gas discharge laser type. Accordingly, the glass-to-metal seal constructions of the invention are most likely to be joined at free end 3 of tubular element 1 to a fused quartz envelope and it is, of course, generally much easier to make quartz-to-quartz fusions than to fuse dissimilar glasses. In any event, it is also preferred that the glass-to-metal seal construction of the invention be performed utilizing a single homogeneous glass composition for the glass elements thereof, whatever the selected glass composition may be, in order to preserve simplicity and avoid a number of excessive and unnecessary forming steps.

As to the second tubular glass element 20, it is additionally preferred that it be of a balloon-type configuration whereby, seriatim, said element 20 extends sharply outwardly from its first end 21 to a diameter substantially greater than the outside diameter of the first tubular glass element 1, smoothly transitions rearwardly at relatively greater diameter than that of first tubular element 1 to a plane located beyond the end of said first cup-shaped metallic seal element 5 and then smoothly transitions to its second end 22 whose diameter is substantially equal to the diameter of first end 2 of first tubular glass element 1.

Furthermore, it is preferred that the first and second refractory metal cup-shaped seal elements 5 and 24 be constructed such that the sidewalls 4 and 23 thereof are internally tapered to feather edges at the open ends thereof. This serves to improve the seal between the cup-shaped refractory metal seal element and the tubular glass element into which it is embedded. A particularly preferred refractory metal for use in the cup-shaped elements 5 and 24 is molybdenum. The fabrication of refractory metal cup-shaped wares having internally tapered sidewalls for use in the construction of glass-to-metal seals is known. In this, reference may be had, for instance, to U.S. Pat. No. 3,685,472, Aug. 22, 1972, to the present applicant.

As will be appreciated, the glass-to-metal seal construction of the invention is possessed of several noteworthy advantages, particularly when employed in the fabrication of high temperature discharge devices of the compact arc discharge lamp or gas discharge laser type. Firstly, in terms of fabrication ease, the glass-to-metal seal construction of the invention is readily performed without recourse to sophisticated glass blowing and joining techniques and without the necessity for fusing several different glass compositions in order to provide sufficient compensation for thermal coefficient of expansion mismatches existing between the metallic and glass elements thereof.

In fabricating a discharge device, of course, the quartz envelope thereof will be fused to the end 3 of first tubular element 1 in such manner as to place the interiors of the envelope and tubular glass element 1 into open communication. Operationally, then, it will first be noted from this construction that the first cup-shaped refractory metal seal element 5 is essentially completely withheld from contact with the atmosphere. Thus, the interior surface of the first cup-shaped refractory metal seal element 5 is exposed only to the environment within the envelope. The exterior surface of said element 5 is exposed only to the evacuated chamber 40, which, perforce, will contain little or no oxygen due to the subatmospheric pressure therein and/or coupled with the further fact that said chamber 40 can also be flushed free of oxygen (or other oxidants) with an inert gas prior to its evacuation and sealing. Thus, those portions of the envelope associated with the seal constructions of the invention can be operated at the high temperatures necessary to avoid condensation of the metal halide or other condensible components onto the interior surface of cup-shaped seal elements 5 while, at the same time, avoiding exposure of the exterior surfaces of said metallic seal elements 5 to oxidative degradation thereof. Secondly, the subatmospheric pressure within the chamber 40 defines an insulative barrier to the transfer of heat from the quartz envelope to the second cup-shaped refractory metal seal element 24. In the glass-to-metal seal of the invention, such heat transfer can take place substantially only by way of conduction through the refractory metal electrode rod 30; however, by virtue of the space between the first and second seal elements 5 and 24, the heat flux into said second cup-shaped seal element 24 will not ordinarily be sufficient to heat said element to temperatures at which oxidation of the exterior surface thereof will be of concern. Further, even if excessive heating of said second refractory metal seal element 24 is experienced, said seal element 24 can be externally cooled, such as by forced air cooling thereof, without substantially affecting the temperature of the zone adjacent first metallic seal element 5. Finally, from the standpoint of thermal coefficient of expansion mismatch problems, it will be seen that the evacuated state of chamber 40 of the glass-to-metal seal construction of the invention places, in effect, the second tubular glass element 20 thereof in compression, thereby urging it to some small extent to lengthen and place the electrode rod 30 in tension between the first and second cup-shaped refractory metal seal elements 5 and 24. Thus, when said rod 30 is heated, by virtue of the relatively greater thermal coefficient of expansion thereof, it lengthens to a greater extent than the second tubular glass element 20, thereby relieving its tensile prestress and even going beyond so as to be placed in compression. Such compressive forces as may be generated under these circumstances are usually readily sustainable in the construction of the invention. But for the presence of the subatmospheric pressure in chamber 40 and the tensile preloading of rod 30 caused thereby, however, said compressive forces might otherwise be found excessive.

Yet another advantage of the construction of the invention resides in the safety factor provided thereby should a seal failure occur in the region of end 2 of first tubular glass element 1. By reason of the presence of the evacuated chamber 40, of course, the contents of the quartz envelope of the discharge device will not spew into the surrounding equipment but rather will be contained by the chamber 40. Thus, even though such a seal leak may fail the device from an operational standpoint, the physical dangers posed thereby will not be as great as those posed by the high temperature discharge devices of the prior art.

While the invention has been described hereinbefore with respect to certain embodiments thereof, it is not intended to be limited thereto, and it should be understood that variations and modifications which are obvious to those skilled in the art may thus be made without departing from the essential spirit or scope thereof.

The embodiments of the invention in which an exclusive property or privilege is claimed are defined as follows:

1. A glass-to-metal seal construction comprising:

(a) a first tubular glass element having first and second ends, said first end having sealingly embedded therein the sidewall of a first cup-shaped refractory metal seal element and said second end defining a free end adapted for fusion sealing thereof to another tubular glass ware;

(b) a second tubular glass element having first and second ends, said first end having a bore of sufficient diameter to receive said first tubular glass element of (a) and being sealingly fused thereto intermediate the first and second ends thereof, said second tubular glass element extending rearwardly and beyond said first end of said first tubular glass element, said second end of said second tubular glass element having sealingly embedded therein the sidewall of a second cup-shaped refractory metal seal element;

(c) a refractory metal electrode rod extending from the base of said second cup-shaped seal element through the base of said first cup-shaped seal element and being sealingly affixed to each said element;

(d) said first and second tubular glass elements, said first and second cup-shaped refractory metal seal elements and said electrode rod defining therebetween a hermetically sealed chamber, said chamber being at subatmospheric pressure.

2. The construction of claim 1 wherein said first and second tubular glass elements are composed of a single glass composition.

3. The construction of claim 2 wherein said glass composition is fused quartz.

4. The construction of claim 1 wherein the sidewalls of said first and second cup-shaped refractory metal seal elements are tapered to feather edges at the open ends thereof.

5. The construction of claim 4 wherein said tapered sidewalls are internally tapered.

6. The construction of claim 1 wherein said first and second cup-shaped refractory metal seal elements are composed of molybdenum.

7. The construction of claim 1 wherein said refractory metal electrode rod extends to beyond the second end of said first tubular glass element.

8. The construction of claim 1 wherein said refractory metal electrode rod is composed of tungsten.

9. The construction of claim 1 wherein the pressure in said chamber is not greater than about 50$\mu$, Hg.

10. The construction of claim 1 wherein said second tubular glass element is of balloon configuration whereby, seriatim, said second tubular glass element extends sharply outwardly from the first end thereof to a diameter substantially greater than the outside diameter of said first tubular glass element, smoothly transitions rearwardly at substantially larger diameter than the outside diameter of said first tubular glass element to a plane located beyond the first end thereof and then smoothly transitions to its second end, said second end having a diameter substantially equal to the diameter of said first end of said first tubular glass element and being essentially coaxial therewith.

11. The construction of claim 1 wherein, in combination:

(i) said first and second tubular glass elements are each composed of fused quartz;

(ii) said first and second cup-shaped refractory metal seal elements are each composed of molybdenum; and (iii) said refractory metal electrode rod is composed of tungsten and is sealingly affixed to the bases of said first and second cup-shaped refractory metal seal elements by means of alloy braze joints said alloy being selected from the group consisting of gold and nickel alloys.

12. In a high temperature gas discharge illuminating device of the type comprising a fused quartz tubular envelope, refractory metal seals joined to said envelope and a refractory metal electrode rod sealingly affixed to each said refractory metal seal and extending into said envelope, the improvement which comprises each said refractory metal seal comprising the construction:

(a) a first tubular fused quartz element having first and second ends, said first end having sealingly embedded therein the sidewall of a first cup-shaped refractory metal seal element and said second end being sealingly fused to said fused quartz tubular envelope, thereby to establish hermetically sealed open communication with the interior thereof;

(b) a second tubular fused quartz element having first and second ends, said first end having a bore of sufficient diameter to receive said first tubular fused quartz element of (a) and being sealingly fused thereto intermediate the first and second ends thereof, said second tubular fused quartz element extending rearwardly and beyond said first end of said first tubular fused quartz element, said second end of said second tubular fused quartz element having sealingly embedded therein the sidewall of a second cup-shaped refractory metal seal element;

(c) a refractory metal electrode rod extending from the base of said second cup-shaped refractory metal seal element, through the base of said first cup-shaped refractory metal seal element and into said envelope, said electrode rod being sealingly affixed to said bases;

(d) said first and second tubular fused quartz elements, said first and second cup-shaped refractory metal seal elements and said electrode rod defining therebetween a hermetically sealed chamber, said chamber being at subatmospheric pressure.

* * * * *